US006244449B1

(12) United States Patent
Pech

(10) Patent No.: US 6,244,449 B1
(45) **Date of Patent: *Jun. 12, 2001**

(54) FREE FALL DISCONNECT

(75) Inventor: David J. Pech, Manitowoc, WI (US)

(73) Assignee: Manitowoc Crane Group, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/834,724

(22) Filed: Apr. 1, 1997

(51) Int. Cl.[7] ..... B66D 1/54
(52) U.S. Cl. ..... 212/170; 254/299; 254/303
(58) Field of Search ..... 212/170, 174, 212/173; 254/299, 303, 346, 349, 365, 307

(56) References Cited

U.S. PATENT DOCUMENTS

| | | | | |
|---|---|---|---|---|
| 1,980,297 | * | 11/1934 | Scott | 254/299 |
| 2,159,250 | * | 5/1939 | Brantly | 254/367 |
| 2,403,095 | * | 7/1946 | Lear | 254/299 |
| 2,428,163 | * | 9/1947 | Hubbard et al. | 212/174 |
| 2,565,791 | * | 8/1951 | Wagner et al. | 254/349 |
| 2,594,666 | * | 4/1952 | Long | 254/367 |
| 2,718,949 | * | 9/1955 | Taylor | 254/299 |
| 2,891,767 | * | 6/1959 | Armington | 254/346 |
| 3,029,955 | * | 4/1962 | Perkins | 212/174 |
| 3,811,657 | * | 5/1974 | Hoover | 254/367 |
| 3,895,699 | * | 7/1975 | Mita et al. | 254/303 |
| 3,921,817 | | 11/1975 | Petrik et al. | 212/66 |
| 4,033,553 | * | 7/1977 | Sugimoto | 254/303 |
| 4,243,148 | * | 1/1981 | Lampson | 212/49 |
| 4,328,954 | | 5/1982 | Logus . | |
| 4,667,933 | * | 5/1987 | Frommherz | 254/303 |
| 4,736,929 | * | 4/1988 | McMorris | 254/365 |
| 4,909,364 | | 3/1990 | Grimm . | |
| 4,932,541 | * | 6/1990 | Belsterling | 212/191 |
| 5,314,262 | * | 5/1994 | Meisinger et al. | 414/137.1 |
| 5,405,027 | | 4/1995 | Plass | 212/152 |
| 5,427,256 | | 6/1995 | Kleppe | 212/179 |

FOREIGN PATENT DOCUMENTS

| | | | | |
|---|---|---|---|---|
| 1082168 | | 7/1980 | (CA) . | |
| 193607 | * | 12/1907 | (DE) | 254/299 |
| 39 33 505 A1 | | 12/1990 | (DE) . | |
| 22127 | * | 10/1906 | (GB) | 254/299 |
| 407954 | * | 3/1934 | (GB) | 212/174 |
| 1044955 | * | 10/1966 | (GB) | 254/299 |
| 1401188 | * | 7/1975 | (GB) | 254/299 |

* cited by examiner

*Primary Examiner*—Thomas J. Brahan
(74) *Attorney, Agent, or Firm*—Brinks Hofer Gilson & Lione

(57) ABSTRACT

A drum drive assembly for cranes which use a load hoist line reeled onto a load hoist line drum to lift loads allows the load hoist line drum to be disconnected from the drum drive motor to permit the load hoist line drum to rotate independent of the drum drive motor. The drum drive assembly comprises one or more motors for rotating the load hoist line drum to either pay out or reel in the load hoist line; a brake for slowing, stopping or preventing the rotation of the load hoist line drum; and a jaw clutch which may be disengaged to permit the load hoist line drum to rotate independently of the motor.

12 Claims, 6 Drawing Sheets

FREE FALL DISCONNECT

BACKGROUND OF THE INVENTION

The present invention relates to cranes that use one or more load hoist lines to lift loads. In cranes of this type, each load hoist line is wrapped, or reeved, around a separate load hoist line drum. The drum is rotated to either pay out or retrieve the load hoist line drum. A drum drive assembly is used to rotate the drum during normal crane lifting operations.

Under certain circumstances, it is desirable to disconnect the drum from the drum drive motor so that it may rotate freely. For example, when a crane is used to repeatedly hoist objects a long vertical distance, it may be faster and/or more economical to allow the influence of gravity acting upon the hook block to pull the load hoist line off of the load hoist line drum between lifts. Once the hook block has been lowered back to the ground, the load hoist line drum is reconnected to the drum drive motor so that the load hoist line can be used to hoist the next object.

One of the purposes of the present invention is to provide a drum drive assembly which will permit the quick, easy, and safe disconnection of the load hoist line drum from the drum drive motor.

SUMMARY OF THE INVENTION

The present invention provides a drum drive assembly for cranes which use a load hoist lines reeled onto a load hoist line drum to lift loads. The drum drive assembly allows the load hoist line drum to be disconnected from the drum drive motor to permit the load hoist line drum to rotate independent of the drum drive motor. This permits the load hoist line to spool, or "free fall," off of the load hoist line drum under the influence of gravity.

The drum drive assembly of the present invention comprises one or more motors for rotating the load hoist line drum to either pay out or reel in the load hoist line; a brake for slowing, stopping or preventing the rotation of the load hoist line drum; and a jaw clutch which may be disengaged to permit the load hoist line drum to rotate independently of the motor. The preferred jaw clutch comprises a drive clutch plate and a driven clutch plate. The drive clutch plate and the driven clutch plate engage each other to connect the motors to the load hoist line drum and disengage from each other to disconnect the motors from the load hoist line drum.

The preferred embodiment of the invention includes features in addition to those listed above. Moreover, the advantages over the current art discussed above are directly applicable to the preferred embodiment, but are not exclusive. The other features and advantages of the present invention will be further understood and appreciated when considered in relation to the detailed description of the preferred embodiment.

DETAILED DESCRIPTION OF THE DRAWINGS AND A PREFERRED EMBODIMENT OF THE INVENTION

Figure 1:
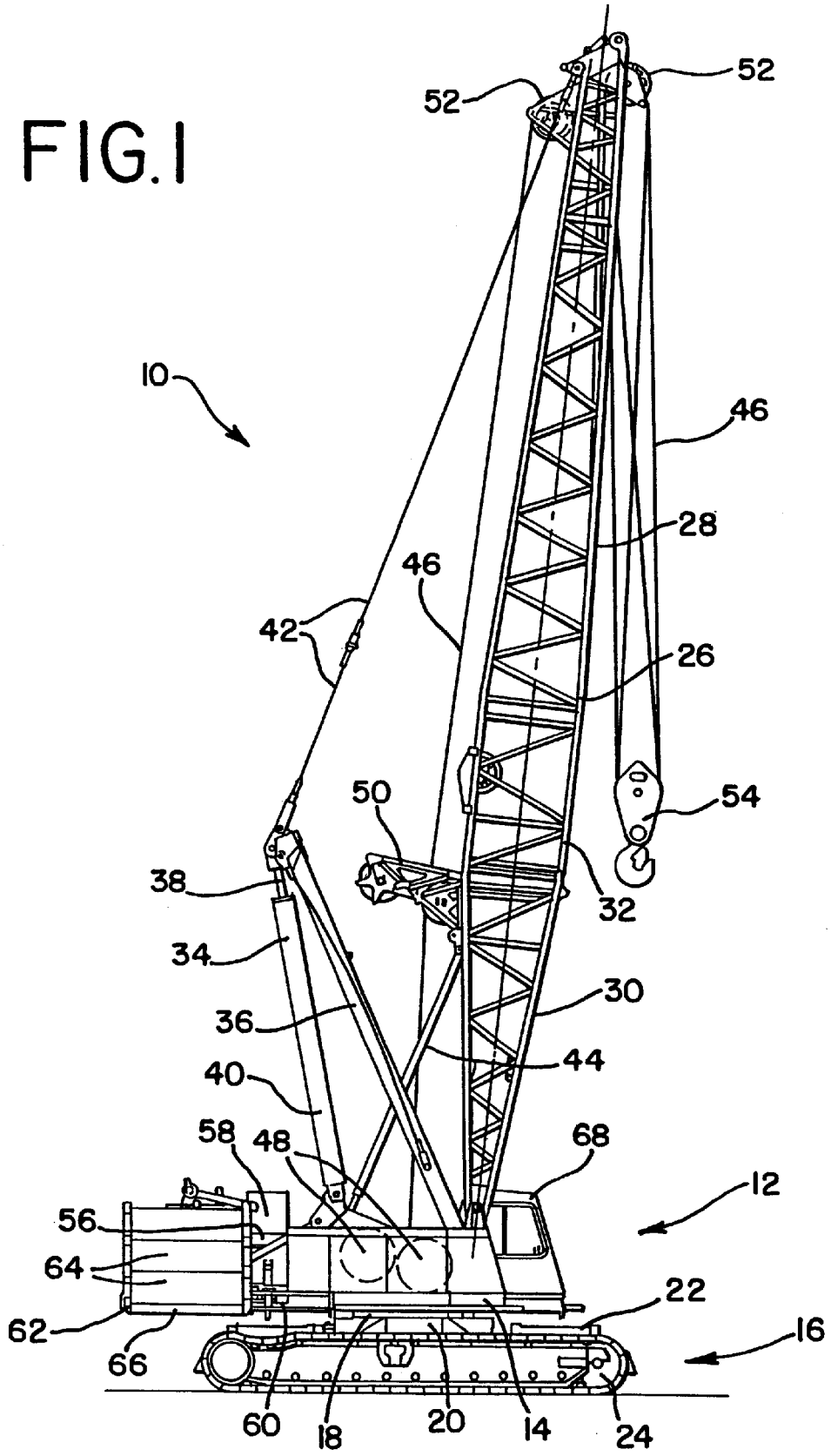
FIG. 1 is a right side elevational view of a complete crawler crane incorporating a free fall disconnect device made in accordance with the teachings of this invention.
Figure 2:
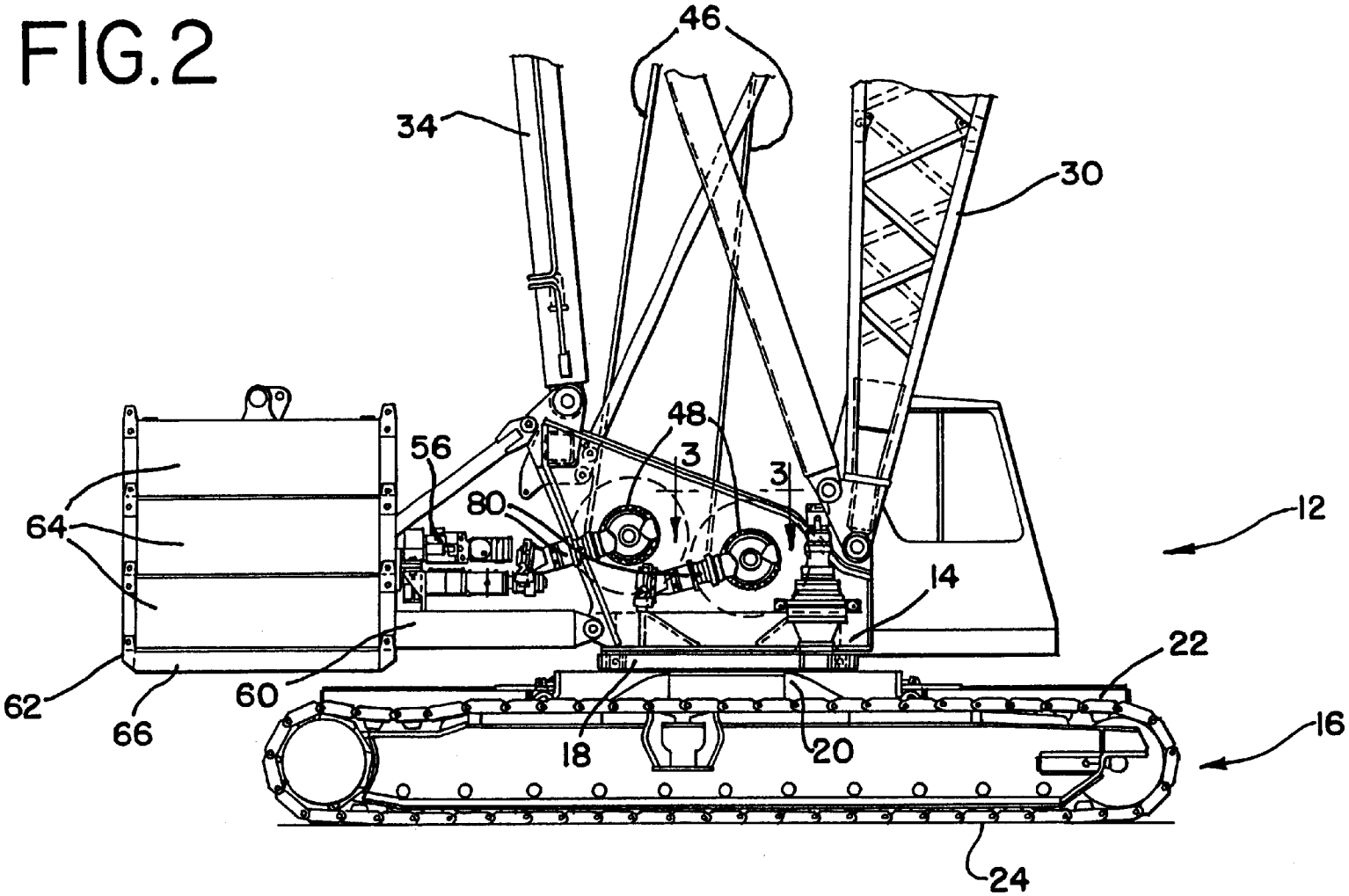
FIG. 2 is a partial right side elevational view of the crawler crane showing some of the internal components of the crane upper works.

While the present invention will find application in all types of crawler vehicles, the preferred embodiment of the invention is described in conjunction with the boom hoist cylinder crawler crane 10 of FIGS. 1 and 2. The boom hoist cylinder crawler crane 10 includes an upper works 12 having a rotating bed 14 which is rotatably connected to a lower works 16 by a swing bearing 18. The lower works 16 includes a car body 20, car body counter weights 22, and two independently powered crawlers 24.

The upper works includes a boom 26 pivotally connected to the upper works 12. The boom 26 comprises a boom top 28 and a tapered boom butt 30. The boom 26 may also include one or more boom inserts 32 connected between the boom top 28 and the boom butt 30 to increase the overall length of the boom 26. The angle of the boom 26 is controlled by a pair of hydraulic boom hoist cylinders 34 pivotally connected to the upper works 12. A mast 36 is pivotally connected between the piston rods 38 of the hydraulic boom hoist cylinders 34 and the upper works 12. The boom hoist cylinders 34 are connected to the upper works 12 at a point preferably near the lower end of the boom hoist cylinders 34, but may be connected to the upper works 12 at any point along the bore 40 of the boom hoist cylinders 34. The boom 26 is connected to the piston rods 38 of the hydraulic boom hoist cylinders 34 and the mast 36 by one or more boom pendants 42. The boom pendants 42 may be connected to either the mast 36 or the piston rods 38 of the hydraulic boom hoist cylinders 34, but preferably are connected at a point near the connection between the mast 36 and the piston rods 38 of the hydraulic boom hoist cylinders 34. A boom backstop 44 is provided to prevent the boom 26 from exceeding a safe operating angle.

The position of the boom 26 is controlled by the hydraulic boom hoist cylinders 34. The mast 36 supports the connection between the hydraulic boom hoist cylinders 34 and the boom pendants 42 at a location that is distanced from the axis of the boom 26 to optimize the forces in the boom pendants 42 and the hydraulic boom hoist cylinders 34. This arrangement also permits the hydraulic boom hoist cylinders 34 to impart a force having a component that is perpendicular to the axis of the boom 26. This force is transferred to the end of the boom 26 by the boom pendants 42.

Extending the hydraulic boom hoist cylinders 34 decreases the angle between the front of the boom 26 and the ground. Conversely, retracting the hydraulic boom hoist cylinders 34 increases the angle between the front of the boom 26 and the ground. Under normal operating conditions, the hydraulic boom hoist cylinders 34 and the boom pendants 42 are in tension from the weight of the boom 26 and any load being lifted by the crane 10. Conversely, the mast 36 is in compression under normal operating conditions.

The upper works 12 further includes one or more load hoist lines 46 for lifting loads. Each load hoist line 46 is reeved around a load hoist line drum 48 supported on the rotating bed 14 of the upper works 12. The load hoist line drums 48 are rotated to either pay out or retrieve the load hoist lines 46. The load hoist lines 46 pass through a wire rope guide 50 attached to the upper interior side of the boom butt 30 and are reeved around a plurality of boom top sheaves 52 located at the upper end of the boom top 28. The wire rope guide 50 prevents the load hoist lines 46 from interfering with the lattice structure of the boom 26. A hook block 54 is typically attached to each load hoist line 46.

As best seen in FIG. 2, the upper works 12 further includes a power plant 56 enclosed by a power plant housing 58 and supported on a power plant base 60. The power plant base 60 is connected to the rear of the rotating bed 14. Connected to the power plant base 60 is a upper counter weight assembly 62 comprising a plurality of counter weights 64 supported on a counter weight tray 66. The power plant 56 supplies power for the various mechanical and hydraulic operations of the crane 10, including movement of the crawlers 24, rotation of the rotating bed 14, rotation of the load hoist line drums 48, and operation of the hydraulic boom hoist cylinders 34. The mechanical and hydraulic connections between the power plant 56 and the above-listed components have been deleted for clarity. Operation of the various functions of the crane 10 are controlled from the operator's cab 68.

As discussed above, the load hoist lines 46 are controlled by rotating the load hoist line drums 48. In particular, the load hoist line drum 48 is rotated in one direction (e.g., clockwise) to pay out the load hoist line 46. Likewise, the load hoist line drum 48 is rotated in the opposite direction (e.g., counter-clockwise) to retrieve the load hoist line 46. Rotation of each load hoist line drum 48 is controlled by one or more drum drive assemblies 80.

Figure 3:
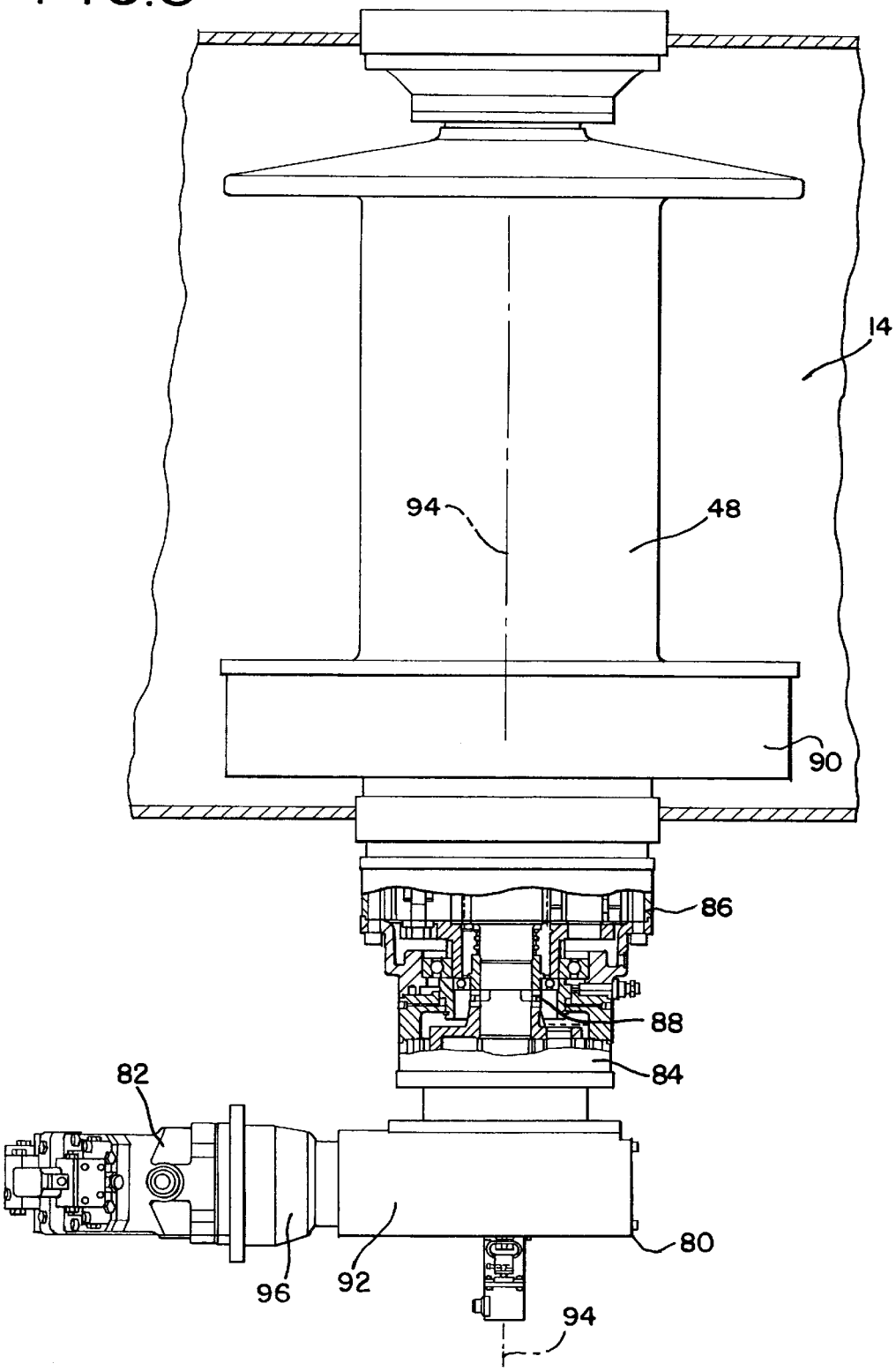
FIG. 3 is a partial sectional view taken along line 3—3 in FIG. 2 showing the load hoist line drum drive assembly incorporating the free fall disconnect device.

As best seen in FIG. 3, each drum drive assembly 80 of the preferred embodiment comprises one or more drum drive motors 82, an input planetary gear set 84, a final drive planetary gear set 86, a jaw clutch assembly 88, and a drum brake assembly 90. Although the preferred embodiment shown utilizes a single drum drive assembly 80 connected to one end of each load hoist line drum 48, a second drum drive assembly 80 can be connected to the other end of each load hoist line drum 48 to increase the drum lifting capacity and/or speed of rotation.

The drum drive motor 82, also known as an accuator, is hydraulically powered and is connected to the power plant 56 by a plurality of hydraulic hoses (not shown). The drum drive motor 82 is capable of rotating the load hoist line drum 48 in either direction and at various speeds to provide optimum control of the load hoist line 46 (which has been deleted from FIG. 3 for clarity). The drum drive motor 82 is connected to a right-angle gear box 92 which changes the direction of the drive shaft by 90 degrees to coincide with the axis of rotation 94 of the load hoist line drum 48. The drum drive motor 82 also comprises a hydraulically activated motor brake 96 to inhibit or stop the rotation of the drum drive motor 82.

An input planetary gear set 84 is connected to the right-angle gear box 92 to reduce the speed of rotation (rpm) delivered by the drum drive motor 82. This reduction in rotational speed is carried out by a series of gear reductions and results in a corresponding increase in the torque, or turning force, delivered by the drum drive motor 82, thereby reducing the size and capacity of motor required to rotate the load hoist line drum 48.

A second planetary gear set, also known as the final drive planetary gear set 86, further increases the torque delivered to load hoist line drum 48 by the drum drive motor 82 through another series of gear reductions. The final drive planetary gear set 86 is located adjacent to the load hoist line drum 48.

The jaw clutch assembly 88 is disengagable to disconnect the load hoist line drum 48 from the drum drive motor 82. This permits the load hoist line drum 48 to rotate freely (i.e., independently of the drum drive motor 28) under the influence of gravity. For example, during certain repetitive lifting operations, it may be faster and more efficient to allow the load hoist line 46 to be paid out, or "free fall", by disengaging the load hoist line drum 48 from the drum drive motor 82. When the load hoist line drum 48 is disengaged, the weight of the hook block 54 tends to "pull" the load hoist line 46 off of the load hoist line drum 48.

Figure 4:
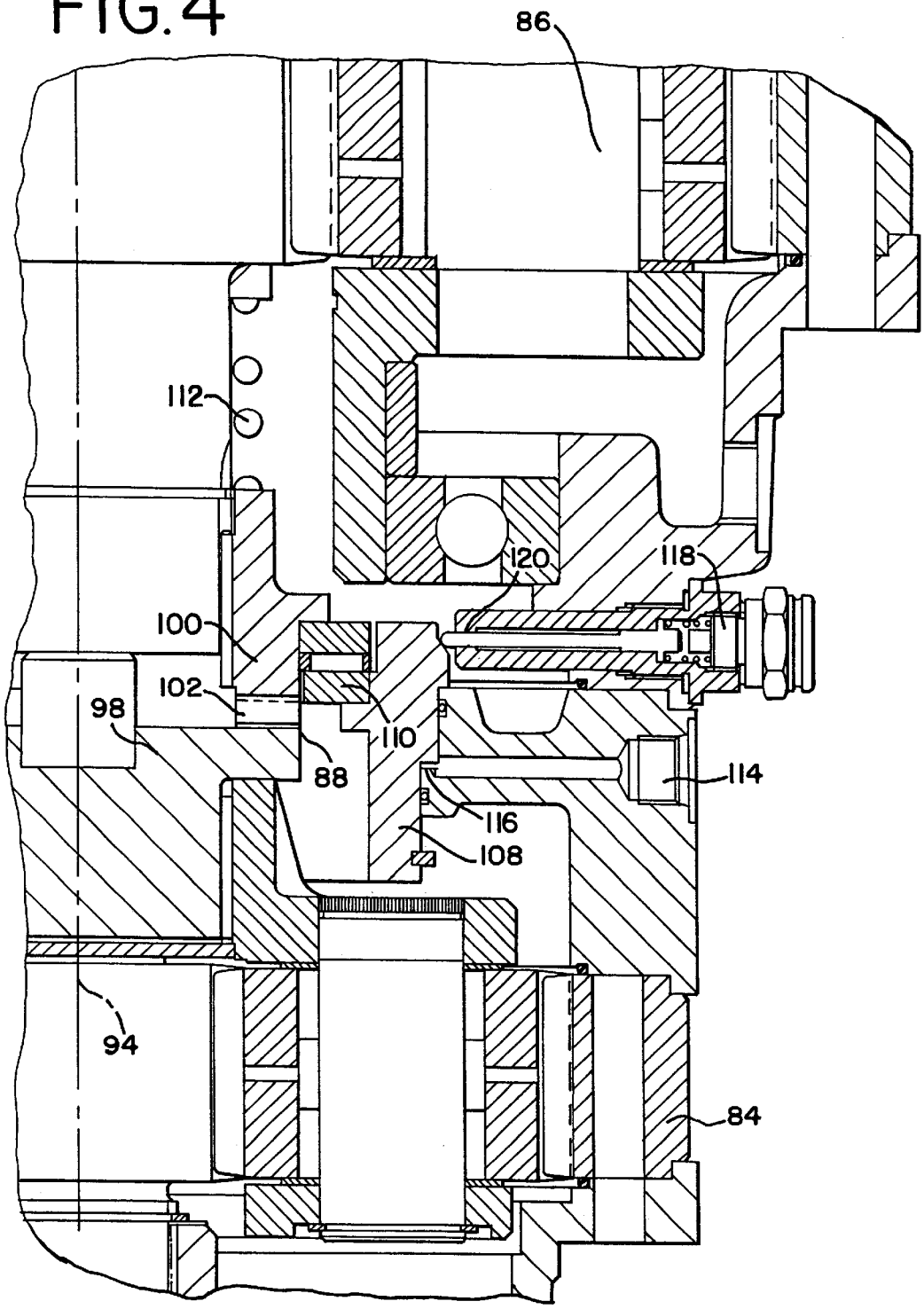
FIG. 4 is a partial sectional view of the free fall disconnect device showing the jaw clutch in the disengaged position.

As best seen in FIG. 4, the jaw clutch assembly 88 is located between the input planetary gear set 84 and the final drive planetary gear set 86. The location of the jaw clutch assembly 88 allows for a disconnection of the drum drive motor 82, right-angle gear box 92, and the input planetary gear set 84 during free fall operations, thereby reducing a majority of the forces resisting free fall induced rotation of the load hoist line drum 48. As a result of the location of the jaw clutch assembly 88, the final drive planetary gear set 86 remains connected to the load hoist line drum 48 when the jaw clutch assembly 88 is disengaged. The final drive planetary gear set 86 provides a degree of rotational resistance to the load hoist line drum 48 for safe free fall operations.

Figure 5:
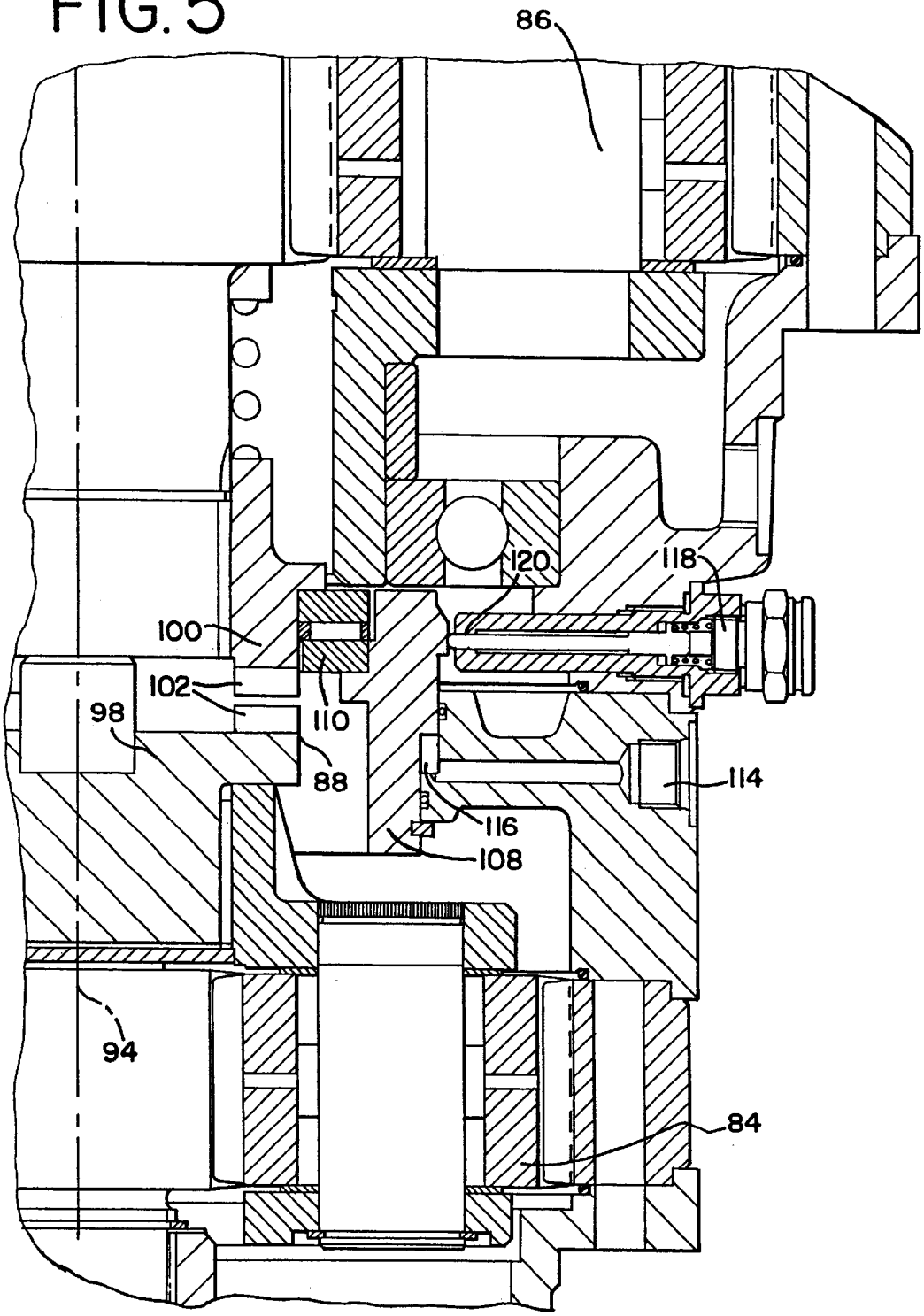
FIG. 5 is a sectional view of the free fall disconnect device showing the jaw clutch in the engaged position.

As best seen in FIG. 4, the jaw clutch assembly 88 comprises a drive clutch plate 98 connected to the input planetary gear set 84, and a driven clutch plate 100 connected to the final drive planetary gear set 86. Both the drive clutch plate 98 and the driven clutch plate 100 rotate about a central axis which, in the preferred embodiment shown, coincides with the axis of rotation 94 of the load hoist line drum 48. As shown in FIG. 4, the drive clutch plate 98 engages the driven clutch plate 100 so as to connect the drum drive motor 82 to the load hoist line drum 48 during normal lifting operations of the crane 10. As shown in FIG. 5, the drive clutch plate 98 is disengaged from the driven clutch plate 100 to disconnect the drum drive motor 82 from the load hoist line drum 48 during free fall lifting operations.

Figure 6:
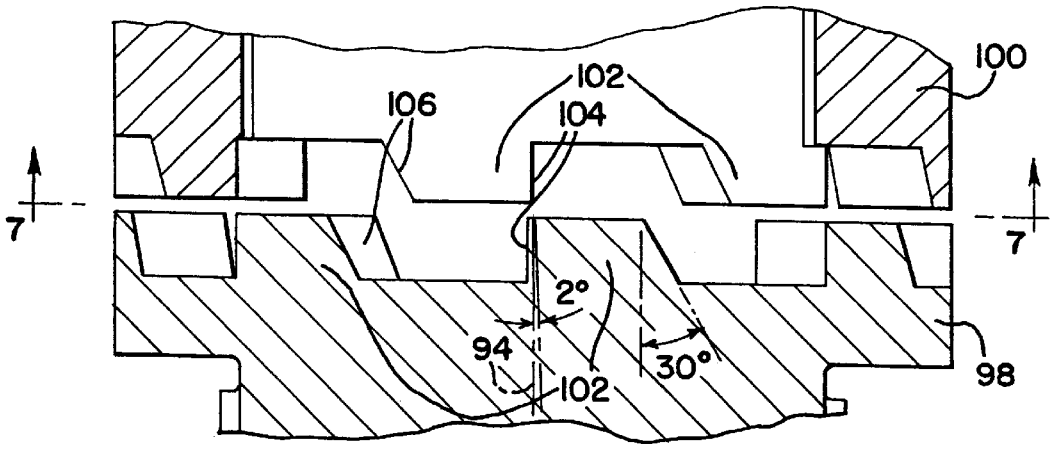
FIG. 6 is a sectional view of the jaw clutch.
Figure 7:
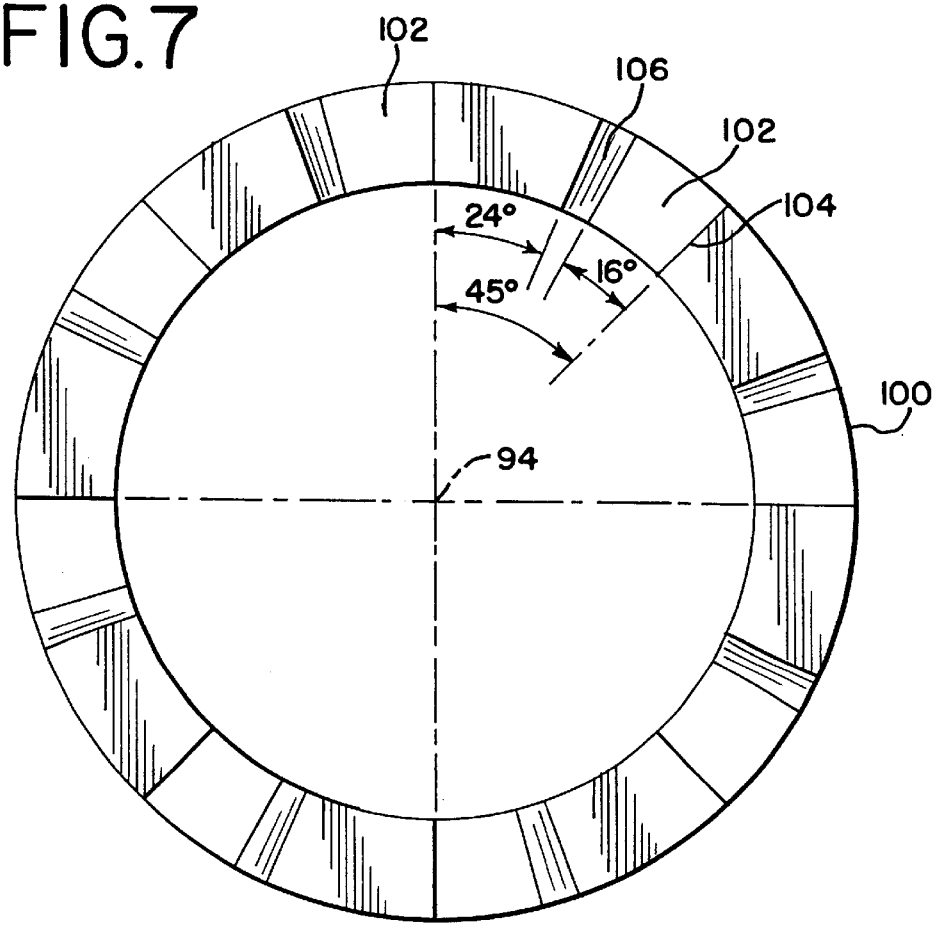
FIG. 7 is a sectional view of the driven jaw clutch taken along line 7—7 in FIG. 6.

As best seen in FIGS. 6 and 7, the drive clutch plate 98 and the driven clutch plate 100 each comprise a plurality of teeth 102. When the jaw clutch assembly 88 is engaged, the teeth 102 interlock to transfer torque from one clutch plate to the other (i.e., clutch plates 98 and 100). In the preferred embodiment shown, the drive clutch plate 98 and the driven clutch plate 100 each comprise eight equally spaced teeth 102 circumferentially disposed about the axis of rotation 94. Each tooth 102 of the preferred embodiment has a leading face 104 and a angled trailing face 106. The leading faces 104 of opposing teeth 102 are engaged during normal crane 10 operations. The angled trailing faces 106 of opposing teeth 102 are only engaged during load hoist line 46 unreeving operations.

As best seen in FIGS. 4 and 5, the driven clutch plate 100 is supported by a annular member 108. A thrust bearing 110 connected between the driven clutch plate 100 and the annular member 108 allows the driven clutch plate 100 to rotate relative to the annular member 108. As will be explained in greater detail below, the annular member 108 controls the position of the driven clutch plate 100 relative to the drive clutch plate 98.

With reference to FIGS. 4 and 5, the jaw clutch assembly 88 is engaged by moving the driven clutch plate 100 towards the drive clutch plate 98 so as to interlock the teeth 102 of one clutch plate with the other. A spring 112 exerts a sufficient force against the driven clutch plate 100 to maintain the jaw clutch assembly 88 in the engaged position. This is the default position of the jaw clutch assembly 88 during normal crane 10 operations (see FIG. 4). To disengage the jaw clutch assembly 88, hydraulic fluid is pumped through a port 114 and into a cavity 116. As the hydraulic fluid accumulates in the cavity 116, it forces the annular member 108 to move horizontally, consequently pushing the driven clutch plate 100 away from the drive clutch plate 98 until the teeth 102 no longer interlock (see FIG. 5). In this position, the driven clutch plate 100 can rotate with the load hoist line drum 48 independent of the drive clutch plate 98, the input planetary gear set 84, and the drum drive motor 82.

In an alternative embodiment not shown, pneumatic air pressure could be used instead of hydraulic fluid to disengage the jaw clutch assembly 88. To reengage the jaw clutch assembly 88, port 114 is opened to allow the hydraulic fluid to exit the cavity 116 under the pressure exerted by the spring 112 on the driven clutch plate 100. As the hydraulic fluid exits the cavity 116, the annular member 108, and consequently the driven clutch plate 100, moves back towards the drive clutch plate 98.

The jaw clutch assembly 88 also comprises a position indicator 118 to indicate whether the jaw clutch assembly 88 is engaged or disengaged. In the preferred embodiment shown, the position indicator 118 detects the position of the driven clutch plate 100 through a plunger type switch 120 connected to the annular member 108. The position indicator 118 also provides a means for insuring that the driven clutch plate 100 has been fully engaged with the drive clutch plate 98.

As best seen in FIG. 3, the drum drive assembly 80 also comprises a drum brake assembly 90. The drum brake assembly 90 is of conventional design such as a drum brake connected to the rim or flange of the load hoist line drum 48. The drum brake assembly 90 is used for slowing, stopping or preventing the rotation of the load hoist line drum 48 during normal crane 10 lifting operations. The drum brake assembly 90 is also used during free fall lifting operations to control the rotation of the load hoist line drum 48 when the jaw clutch assembly 88 is disengaged.

Thus, while an embodiment of the present invention has been described herein, those with skill in this art will recognize changes, modifications, alterations and the like which still shall come within the spirit of the inventive concept, and such are intended to be included within the scope of the invention as expressed in the following claims.

What is claimed is:

1. A crane having an upper works rotatably mounted on a lower works, a load hoist line for lifting loads, a load hoist line drum onto which said load hoist line is reeled, and a drum drive assembly, wherein said drum drive assembly comprises:

a) a hydraulically powered motor for rotating said load hoist line drum to either pay out or reel in said load hoist line;

b) a first brake for inhibiting the rotation of said motor;

c) a second brake connected to said load hoist line drum for inhibiting the rotation of said load hoist line drum; and d) a jaw clutch having an axis of rotation and connecting said motor to said load hoist line drum, said jaw clutch being disengagable to permit said load hoist line drum to rotate independently of said motor and under the influence of gravity acting upon a load being supported by the load hoist line, said jaw clutch comprising a drive clutch plate having a plurality of equally spaced teeth and a driven clutch plate having a plurality of equally spaced teeth, wherein said teeth of said drive clutch plate and said teeth of said driven clutch plate are oriented in a direction parallel to said axis of rotation, further wherein said teeth of said drive clutch plate interlock with said teeth of said driven clutch plate to engage said jaw clutch, further wherein a spring is used to engage said teeth of said drive clutch plate with said teeth of said driven clutch plate, said spring exerting a force on said driven clutch plate so as to bias said drive clutch plate and said driven clutch plate together.

2. A crane according to claim 1 wherein hydraulic fluid is used to disengage said teeth of said drive clutch plate from said teeth of said driven clutch plate by exerting a force on said driven clutch plate in such a manner that said driven clutch plate is moved away from said drive clutch plate.

3. A crane according to claim 1 wherein compressed air is used to disengage said teeth of said drive clutch plate from said teeth of said driven clutch plate by exerting a force on said driven clutch plate in such a manner that said driven clutch plate is moved away from said drive clutch plate.

4. A crane according to claim 1 wherein said jaw clutch further comprises a position indicator device to indicate whether said jaw clutch is engaged or disengaged.

5. A crane according to claim 1 wherein said drum drive assembly further comprises a first and a secondary planetary gear set and said jaw clutch is located between said first and said second planetary gear sets.

6. A crane according to claim 1 wherein said teeth of said drive clutch plate and said teeth of said driven clutch plate each comprise a leading face and an angled trailing face, further wherein the leading faces of said teeth of said drive clutch plate interlock with the leading faces of said teeth of said driven clutch plate to engage said jaw clutch during normal load hoist line reeving operations.

7. A crane according to claim 6 wherein the angled trailing faces of said teeth of said drive clutch plate interlock with the angled trailing faces of said teeth of said driven clutch plate to engage said jaw clutch during load hoist line unreeving operations.

8. A crane having an upper works rotatably mounted on a lower works, a load hoist line for lifting loads, a load hoist line drum onto which said load hoist line is reeled, and a drum drive assembly, wherein said drum drive assembly comprises:

a) a hydraulically powered motor for rotating said load hoist line drum to either pay out or reel in said load hoist line;

b) a hydraulically activated brake for inhibiting the rotation of said motor;

c) a load hoist line drum brake for inhibiting the rotation of said load hoist line drum;

d) a jaw clutch having an axis of rotation and connecting said motor to said load hoist line drum, said jaw clutch being disengagable to permit said load hoist line drum to rotate independently of said motor and under the influence of gravity acting upon a load being supported by the load hoist line, said jaw clutch comprising a drive clutch plate having a plurality of equally spaced teeth and a driven clutch plate having a plurality of equally spaced teeth, wherein said teeth of said drive clutch plate and said teeth of said driven clutch plate are oriented in a direction parallel to said axis of rotation and each comprise a leading face and an angled trailing face, further wherein the leading faces of said teeth of said drive clutch plate interlock with the leading faces of said teeth of said driven clutch plate to engage said jaw clutch during normal load hoist line reeving operations, further wherein a spring is used to engage said teeth of said drive clutch plate with said teeth of said driven clutch plate, said spring exerting a force on said jaw clutch so as to bias said drive clutch plate and said driven clutch plate together;

e) a first planetary gear set connected between said motor and said drive clutch plate of said jaw clutch for changing the angular speed of rotation of the drive clutch plate relative to the angular speed of rotation of the motor; and f) a second planetary gear set connected between said driven clutch plate of said jaw clutch and said load hoist line drum for changing the angular speed of rotation of the load hoist line drum relative to the angular speed of rotation of the driven clutch plate.

9. A crane according to claim 8 wherein hydraulic fluid is used to disengage said teeth of said drive clutch plate from said teeth of said driven clutch plate by exerting a force on said driven clutch plate in such a manner that said driven clutch plate is moved away from said drive clutch plate.

10. A crane according to claim 8 wherein compressed air is used to disengage said teeth of said drive clutch plate from said teeth of said driven clutch plate by exerting a force on said driven clutch plate in such a manner that said driven clutch plate is moved away from said drive clutch plate.

11. A crane according to claim 8 wherein said jaw clutch further comprises a position indicator device to indicate whether said jaw clutch is engaged or disengaged.

12. A crane according to claim 8 wherein the angled trailing faces of said teeth of said drive clutch plate interlock with the angled trailing faces of said teeth of said driven clutch plate to engage said jaw clutch during load hoist line unreeving operations.

* * * * *